US005342052A

United States Patent [19]

Costa

[11] Patent Number: 5,342,052

[45] Date of Patent: Aug. 30, 1994

[54] CAVITY PUTTER

[75] Inventor: Peter Costa, Bloomington, N.Y.

[73] Assignee: Joseph B. Taphorn, Poughkeepsie, N.Y. ; a part interest

[21] Appl. No.: 22,445

[22] Filed: Feb. 25, 1993

[51] Int. Cl.[5] ..... A63B 69/36; A63B 53/04

[52] U.S. Cl. ..... 273/167 H; 273/167 J; 273/171; 273/186.4

[58] Field of Search ..... 273/84 R, 58 H, 78, 273/186.5, 186.4, 167 J, 58 B, 26 B, 171, 173, 174, 194 A, 167 R, 167 F, 167 H; 482/109

[56] References Cited

U.S. PATENT DOCUMENTS

| | | | |
|---|---|---|---|
| 1,939,414 | 12/1933 | Sametz | 273/194 A |
| 3,231,281 | 1/1966 | Wallo | 482/109 X |
| 3,574,379 | 4/1971 | Jordan | 273/78 |
| 3,971,559 | 7/1976 | Diforte | 273/26 B |
| 4,151,994 | 5/1979 | Stalberger | 273/58 A |
| 4,378,113 | 3/1983 | Piccini | 273/26 B |
| 5,064,197 | 11/1991 | Eddy | 273/78 X |

FOREIGN PATENT DOCUMENTS

| | | | |
|---|---|---|---|
| 2717 | of 1909 | United Kingdom | 273/167 J |
| 8789 | 4/1989 | United Kingdom | 273/78 |

*Primary Examiner*—Geroge J. Marlo

*Attorney, Agent, or Firm*—Joseph B. Taphorn

[57] ABSTRACT

A golf putter is formed with a hollow box open towards its striking face which is tautly covered with a layer or two of leather. The cavity in the box behind the leather is filled with a displaceable material such as sand or liquid. The leather indents on striking a golf ball to provide more "feel" and accuracy.

8 Claims, 1 Drawing Sheet

CAVITY PUTTER

INTRODUCTION

1. Field of the Invention

This invention relates to golf putters, and more particularly to a golf putter providing a better "feel" and greater accuracy.

2. Background of the Invention

Golf is a game wherein a golf ball is repeatedly struck over a round of eighteen holes. Each hole consists of a tee from which the ball is initially struck by a club, a green having a cup (hole in the ground) into which it is the object of the game to get the ball to fall with the fewest number of strokes from the tee, and usually a fairway (mowed grass) into and from which it is desirable to hit the ball enroute to the green. Once on the green, a club called the putter is employed to roll the ball towards, and hopefully into, the cup.

3. Prior Art

Existing putters employ a firm face, usually of metal, to hit the golf ball. The striking of the golf ball with the putter firm face results in a momentary contact which allows any mometary mis-alignment of the perpendicular putter face to mix-direct the struck golf ball.

SUMMARY OF THE INVENTION

Accordingly it is an object of the invention to provide a more accurate putter.

A more specific object of the invention is to provide a putter that provides the golfer with a better "feel" for controlling the direction in which his golf stroke hits the ball.

Yet another object of the invention is to provide a putter that is simple of construction and easy of manufacture.

The objects of the invention are accomplished by mounting a generally hollow box, of metal or the like and roughly the size of a standard putter head, at the bottom end of a putter shaft. The ball-striking face of the hollow box is open and covered with a layer or two of taut flexible material such as leather fixed as by gluing to the portions of the hollow box about its opening. The cavity in the hollow box behind the flexible material is filled with a displaceable material such as sand or a liquid.

BRIEF DESCRIPTION OF THE DRAWINGS OF AN EMBODIMENT OF THE INVENTION

These and other objects, features and advantages of the invention will become apparent from a reading of the following description of a preferred embodiment of the invention, when considered with the attached drawings wherein.

DETAILED DESCRIPTION OF A PREFERRED EMBODIMENT OF THE INVENTION

Figure 1:
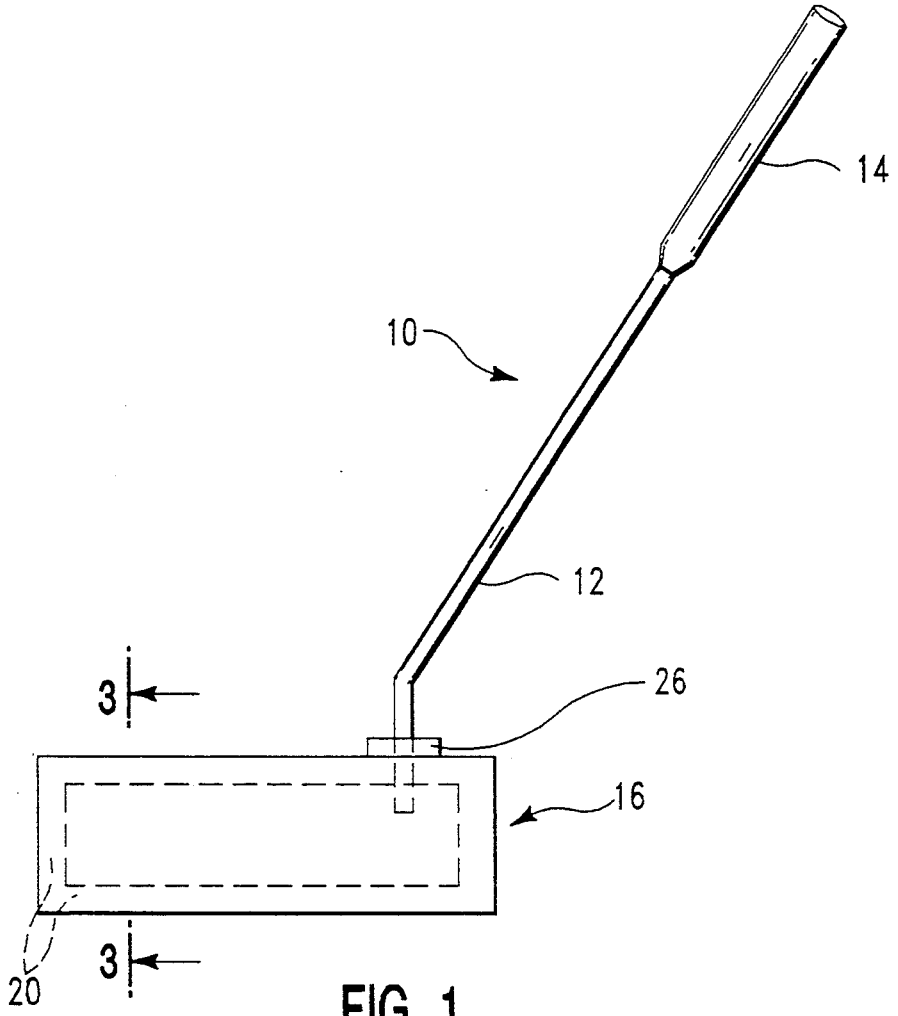
FIG. 1 is an isometric side view of a putter constructed according to the invention and showing the ball striking face.
Figure 3:
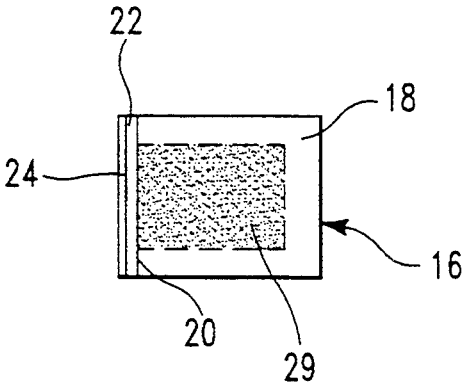
FIG. 3 is a cross-sectional view of the putter head taken along the line 3—3 of FIG. 1.

Referring now more particularly to the drawings, there is shown in FIG. 1 a putter generally indicated by the numeral 10. The putter 10 includes a conventional bent shaft 12, the upper end of which is covered with a conventional grip of a somewhat flexible material such as leather or rubber for a golfer to handle the club and hold it during swinging action. On the lower end of the shaft 12 is secured a head generally indicated by the numeral 16 for striking the golf ball.

The putter head 16 consists of a hollow, generally rectangular (or other suitably shaped) box 18 of metal or the like and open towards the ball striking face, that is, the face in FIG. 1 facing the viewer. The box provides vertical surfaces 20 about the opening for purposes which will soon become evident.

The ball striking face of the putter head 16 is created by covering the box opening with a taut layer 22 or two 24 of leather. The layer 22 would be secured across the head opening by being glued at its outer edges to the box vertical surfaces 20 about its opening. If the second layer 24 is employed, it would be glued across the outer surface of the inner layer 22.

Figure 2:
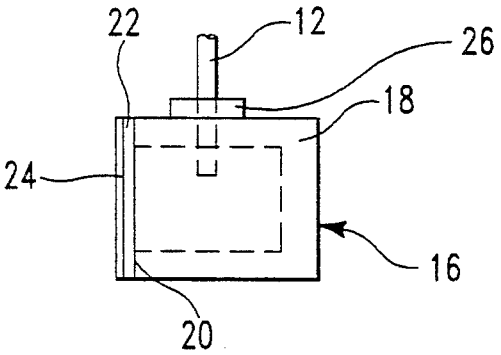
FIG. 2 is right hand end view of a portion of the putter shown in FIG. 1.

As best appreciated from FIGS. 1 and 2, the shaft 12 is secured to the head by being threadedly received in a vertical through-opening in the upper surface of the hollow box 18. The shaft and head are locked in place by a lock nut 26 also threaded on the shaft and engaging the upper surface of the box 18.

The cavity in the hollow box 18 behind the leather layer 22 is filled with a displaceable granular material such as sand 29, or liquid such as water, to allow yielding (indenting) of the club face at the point of impact with the ball. While the filler may be placed in the cavity in various ways and times, I have found it best to pour the sand or liquid into the cavity after the leather layer 22 has been secured across the opening in the box 18. This pouring is done through the vertical opening in the top of the box 18 and before the shaft 12 is threaded thereinto and locked in place by the lock nut 26. Of course, in colder climes, concern must be shown in wintertime about the freezing of water fillers and their expansion properties thereupon.

In use, the putter of the invention would be swung by the golfer just like any other putter. However, upon the leather layer 22 or 24 striking the ball, it will indent inwards, rather than deliver a sharp blow sending the ball in a direction perpendicular to any momentary misalignment of the club face. Thus a longer moment of contact with the golf ball will obtain, sending the ball more in the overall direction of the swing rather than that of any momentary twitch. The sand or liquid behind the indent point will momentarily displace against other areas of the leather or into empty areas of the cavity if it was not full, and will return to initial position from the pressures induced by leather displacement elsewhere or the forces of gravity.

Thus applicant has produced a putter enabling greater accuracy from a better "feel" in the swing.

While applicant has shown a preferred embodiment of the invention, it will be apparent to those skilled in the art that other and different applications may be made of the principals of the invention. Accordingly it is intended to be limited only by the scope or spirit of the appended claims.

What is claimed is:

1. A method for making a golf putter, comprising securing tautly a layer of yieldable supple sheet material across the vertical open face of a box having an internal cavity therein, filling said cavity behind said layer of material with a displaceable liquid or granular material, and securing a shaft to said box.

2. A golf putter comprising a shaft and a head connected thereto, said head having an opening therein and a generally vertical ball striking face including a taut layer of yieldable, supple, sheet material secured across said opening so that said face will indent inward upon striking a golf ball and a longer moment of contact with the golf ball is obtained to thereby direct the golf ball more in the overall direction of the swing rather than in the direction of any momentary misalignment of the club face.

3. A golf putter according to claim 2, wherein the yieldable material is leather.

4. A golf putter according to claim 2, wherein the head has a second layer of yieldable material over the first mentioned layer of yieldable material.

5. A golf putter according to claim 2, wherein the head opening is formed by a hollow box.

6. A golf putter according to claim 5, wherein an opening is formed in the top of the box and the lower end of the shaft is secured therein.

7. A golf putter according to claim 5, wherein the opening is filled with a displaceable material.

8. A golf putter according to claim 2, wherein the head includes vertical surfaces about said opening for attaching the yieldable layer thereto with an adhesive.

* * * * *

UNITED STATES PATENT AND TRADEMARK OFFICE

CERTIFICATE OF CORRECTION

PATENT :5,342,052

DATED : AUG. 30, 1994

INVENTOR(S) : Peter Costa

It is certified that error appears in the above-identified patent and that said Letters Patent is hereby corrected as shown below:

Column 1, line 25 "mix-direct" insert --mis-direct--.

Signed and Sealed this

Twenty-fifth Day of October, 1994

*Attest:*

Bruce Lehman

BRUCE LEHMAN

*Attesting Officer*

*Commissioner of Patents and Trademarks*